US008991824B2

(12) United States Patent
Suzuki

(10) Patent No.: US 8,991,824 B2
(45) Date of Patent: Mar. 31, 2015

(54) SHEET CONVEYING APPARATUS AND IMAGE FORMING APPARATUS

(71) Applicant: Canon Kabushiki Kaisha, Tokyo (JP)

(72) Inventor: Masato Suzuki, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/096,348

(22) Filed: Dec. 4, 2013

(65) Prior Publication Data

US 2014/0159303 A1 Jun. 12, 2014

(30) Foreign Application Priority Data

Dec. 12, 2012 (JP) ..... 2012-271400

(51) Int. Cl.

| | |
|---|---|
| ***B65H 39/10*** | (2006.01) |
| ***B65H 29/58*** | (2006.01) |
| ***B65H 29/60*** | (2006.01) |
| ***B65H 85/00*** | (2006.01) |
| ***G03G 15/23*** | (2006.01) |
| ***G03G 15/00*** | (2006.01) |

(52) U.S. Cl.

CPC ..... *B65H 29/58* (2013.01); *B65H 29/60* (2013.01); *B65H 2404/6112* (2013.01); *B65H 2404/63* (2013.01); *B65H 2404/741* (2013.01); *B65H 2404/7414* (2013.01); *B65H 85/00* (2013.01); *B65H 2301/33312* (2013.01); *B65H 2404/632* (2013.01); *B65H 2555/13* (2013.01); *B65H 2801/06* (2013.01); *G03G 15/234* (2013.01); *G03G 15/6529* (2013.01); *G03G 2215/00675* (2013.01)

USPC ..... 271/303; 271/301; 271/302; 271/265.01

(58) Field of Classification Search

CPC .. B65H 29/58; B65H 29/60; B65H 2404/632; B65H 2404/6112; B65H 2404/63; B65H 2404/741; B65H 2404/7414; B65H 2404/743; B07C 3/065

USPC ..... 271/265.01, 301–303

See application file for complete search history.

(56) References Cited

U.S. PATENT DOCUMENTS 5,515,152 A * 5/1996 Kuo ..... 399/406
5,862,435 A 1/1999 Suzumi et al.

(Continued)

FOREIGN PATENT DOCUMENTS

JP 04-226226 A 8/1992
JP 05-286627 A 11/1993

(Continued)

*Primary Examiner* — Prasad Gokhale

(74) *Attorney, Agent, or Firm* — Fitzpatrick, Cella, Harper & Scinto

(57) ABSTRACT

Provided is a sheet conveying apparatus which conveys a sheet, includes: a sheet conveying path which diverges into a first conveying path and a second conveying path at a diverging point; a guide member which is movable between a first position where the guide member guides the sheet to the first conveying path and a second position where the guide member guides the sheet to the second conveying path; a driving portion which is configured to move the guide member to the second position from the first position; and a holding portion which, in a case that the guide member is driven by the driving portion to move to the second position from the first position, provides a load to the driving by the driving portion and holds the guide member at a third position between the first position and the second position.

17 Claims, 16 Drawing Sheets

(56) References Cited

U.S. PATENT DOCUMENTS

| | | | | |
|---|---|---|---|---|
| 6,185,383 | B1 | 2/2001 | Kanari et al. | |
| 6,298,213 | B1 | 10/2001 | Miyamoto et al. | |
| 6,965,742 | B2 | 11/2005 | Miyamoto et al. | |
| 7,572,864 | B2 | 8/2009 | Mertens et al. | |
| 7,810,811 | B2 | 10/2010 | Suzuki et al. | |
| 8,011,659 | B2 * | 9/2011 | Tabata | 271/303 |
| 8,393,622 | B2 * | 3/2013 | Choi et al. | 271/303 |
| 2002/0109290 | A1 * | 8/2002 | Wurschum | 271/303 |
| 2008/0021131 | A1 | 1/2008 | Mertens et al. | |
| 2011/0018192 | A1 * | 1/2011 | Moore et al. | 271/225 |
| 2012/0228824 | A1 * | 9/2012 | St. Ours et al. | 271/304 |

FOREIGN PATENT DOCUMENTS

| | | | |
|---|---|---|---|
| JP | 07-252002 | A | 10/1995 |
| JP | 2001-106409 | A | 4/2001 |
| JP | 3217083 | B2 | 8/2001 |
| JP | 2004509196 | A | 3/2004 |
| JP | 2008-074553 | A | 4/2008 |
| JP | 4289739 | B2 | 4/2009 |

* cited by examiner

SHEET CONVEYING APPARATUS AND IMAGE FORMING APPARATUS

BACKGROUND OF THE INVENTION

1. Field of the Invention

The invention relates to a sheet conveying apparatus which conveys a sheet within a sheet conveying path.

2. Description of the Related Art

In the related art, an image forming apparatus of an electrophotographic system, such as a printer, a copying machine, or a facsimile is configured so as to form an image on double sides of a sheet by forming the image one side of the sheet with an image forming portion, reversing the sheet with a reverse portion, and conveying once again the reversed sheet to the image forming portion.

In such an apparatus, a switching member, in which a flapper-shaped member is swingingly configured, is provided to make a switching such that the sheet is conveyed to a discharge conveying path, which discharges the sheet into the outside of the apparatus, or a reverse conveying path, which is provided with the reverse portion. A solenoid is used as a switching unit which switches the switching member to receive instruction from a controller within an image forming apparatus body, and thus the conveying path is selectively switched.

Generally, when a preceding sheet is conveyed to the discharge conveying path side and a succeeding sheet is conveyed to the reverse conveying path side, after a trailing end of the preceding sheet passes through the switching member, the switching member starts a switching operation of the conveying path as the solenoid operates by receiving the instruction from the controller. Then, the switching operation of the conveying path is completed while a leading end of the succeeding sheet reaches the switching member.

However, a speeding-up of the image forming apparatus has been advanced in recent years, and the speeding-up is achieved by shortening an interval between sheets to be conveyed continuously. Meanwhile, the conventional switching operation of the switching member has a certain amount of variation due to a response delay of the solenoid. When the interval between the sheets to be conveyed continuously is gradually shortened, there is a possibility that the interval is not in time between the start and completion of the operation of the switching member due to the variation. In the worst case, the leading end of the succeeding sheet reaches the switching member before the switching operation of the switching member is completed, and thus a jam may occur or the sheet may be damaged.

In order to solve these problems, a following configuration is disclosed in Japanese Patent Laid-Open No. 2001-106409. That is, the solenoid is in ON before the trailing end of the preceding sheet passes through a double-side switching member, and a semi-closed position state is provided to convey while interposing the preceding sheet with the double-side switching member and a conveying guide. Then, when the trailing end of the preceding sheet passes through the double-side switching member, the double-side switching member of the semi-closed position state becomes a completely-closed position.

Thereby, even when the interval between the sheets is short, a conveying path switching operation can be performed. Further, a slip does not occur in such a manner that a conveying force of a reverse roller which reverses the preceding sheet at a downstream side of the double-side switching member is sufficiently larger than a conveying resistance due to an abutting pressure between the double-side switching member and the conveying guide.

In addition, a configuration, which switches the switching member to select three conveying paths, has been proposed Japanese Patent Laid-Open No. 5-286627.

As described above, in Japanese Patent Laid-Open No. 2001-106409, even when the sheet is interposed between the switching member and the conveying member, the slip does not occur in such a manner that the conveying force of the conveying roller which conveys at the downstream side is sufficiently larger than the conveying resistance due to the abutting pressure between the switching member and the conveying guide. However, as the conveying force increases, a size of a motor becomes larger, resulting in increasing the cost. In addition, a roller having a small conveying force, for example, a roller that conveys without a nip, such as a comb-tooth discharge roller is not disposed just behind the switching member.

In addition, due to high image quality in recent years, when the sheet is interposed with the switching member and the guide at a state in which the sheet temperature immediately after fixing is high and a fixed image surface and a conveying rib come in contact with each other, there is a conspicuous problem in that unevenness density of the image between a contact surface and a non-contact surface with the conveying rib is caused.

In addition, since the configuration disclosed in Japanese Patent Laid-Open No. 5-286627 is complicated, a space is required and a manufacturing cost is expensive.

SUMMARY OF THE INVENTION

The invention has been made to solve the above-described problems. The invention is desirable to provide an apparatus that conveys a sheet with a simple and inexpensive configuration to cope with a case in which an interval between sheets to be conveyed continuously is short.

According to the invention, a sheet conveying apparatus which conveys a sheet includes: a sheet conveying apparatus which conveys a sheet, comprising: a sheet conveying path which diverges into a first conveying path and a second conveying path at a diverging point; a guide member which is movable between a first position where the guide member guides the sheet to the first conveying path and a second position where the guide member guides the sheet to the second conveying path; a driving portion which is configured to move the guide member to the second position from the first position; and a holding portion which, in a case that the guide member is driven by the driving portion to move to the second position from the first position, provides a load to the driving by the driving portion and holds the guide member at a third position between the first position and the second position.

Further features of the present invention will become apparent from the following description of exemplary embodiments with reference to the attached drawings.

DESCRIPTION OF THE EMBODIMENTS

Hereinafter, with reference to the drawings, an embodiment in which an electrophotographic printer is applied as an example of a sheet discharge apparatus and an image forming apparatus provided with the sheet discharge apparatus according to the invention is specifically described. Unless otherwise specified, scope of the invention should not be construed restrictively in terms of dimensions, materials, and shapes of components, and relative arrangement thereof, which are described in these embodiments.

Figure 1:
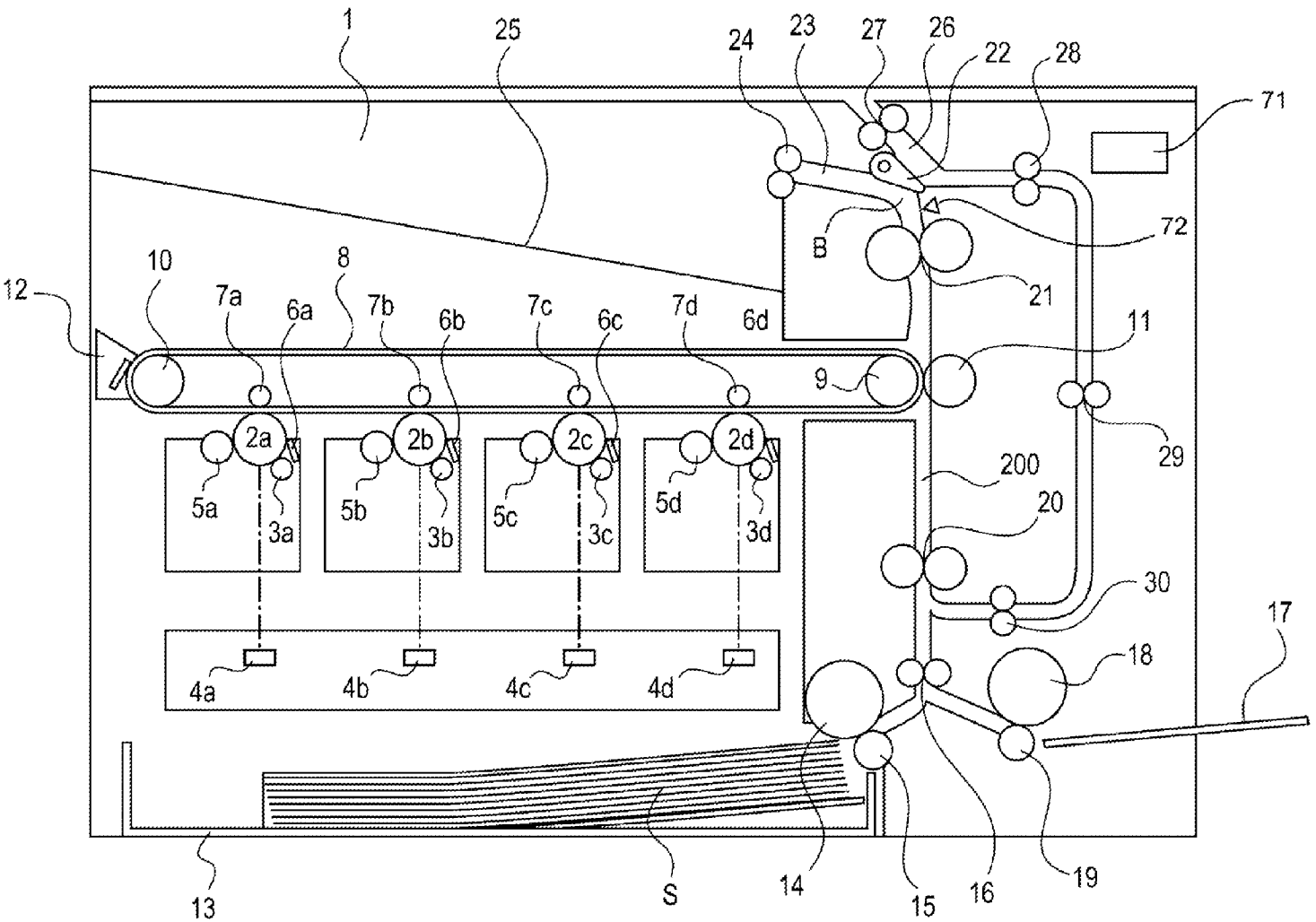
FIG. 1 is an example of a sheet conveying apparatus according to a first embodiment of the invention and a cross-sectional view illustrating a configuration of an image forming apparatus of a color electrophotographic system.
Figure 2:
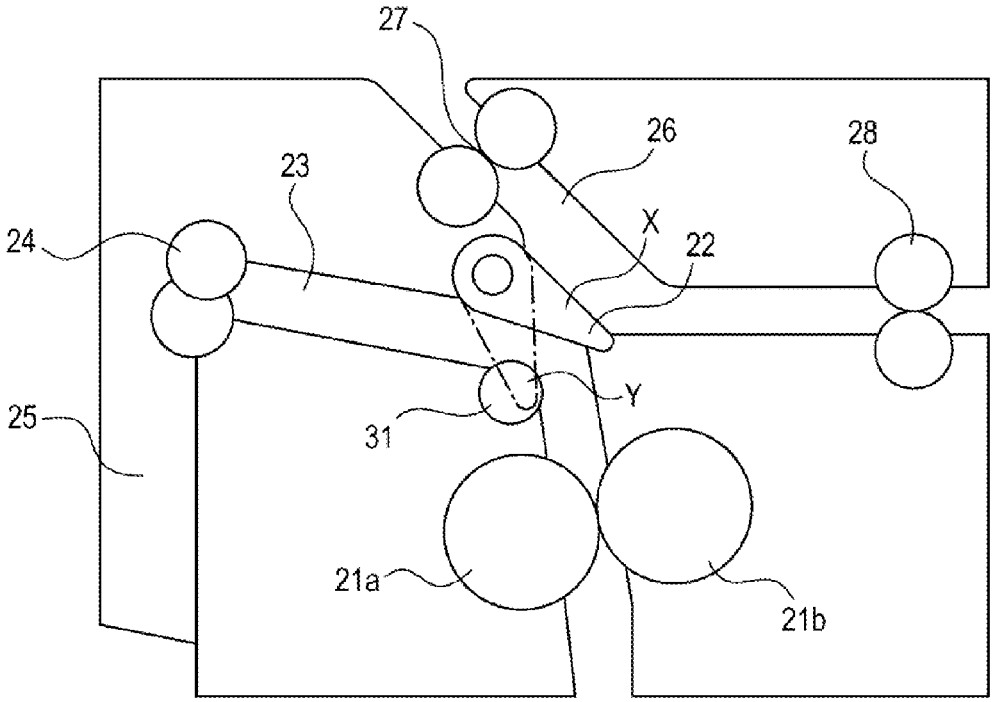
FIG. 2 is a cross-sectional view illustrating a detailed configuration of a periphery a double-side switching member according to the first embodiment of the invention.

[First Embodiment] FIG. 1 is an example of a sheet conveying apparatus according to a first embodiment of the invention and a cross-sectional view illustrating a configuration of an image forming apparatus of a color electrophotographic system, and FIG. 2 is a cross-sectional view illustrating a detailed configuration of a periphery a double-side switching member, which is a conveying path switching member.

(Overall Configuration of Image Forming Apparatus) An image forming apparatus 1 is provided with four drum-shaped image bearing members which are juxtaposedly arranged in a substantially horizontal direction as an image bearing member, that is, photosensitive drums 2 (2*a*, 2*b*, 2*c*, and 2*d*). The photosensitive drum 2 is rotationally driven in a clockwise direction in FIG. 1.

In addition, a charging device 3 (3*a*, 3*b*, 3*c*, and 3*d*) is provided to uniformly charge a surface of the photosensitive drum 2. Moreover, a scanner unit 4 (4*a*, 4*b*, 4*c*, and 4*d*) is provided to form an electrostatic latent image on each photosensitive drum 2 by irradiation of a laser beam based on image information.

In addition, a developing device 5 (5*a*, 5*b*, 5*c*, and 5*d*) is provided to develop the electrostatic latent image as a toner image by attaching a toner including a developer to the electrostatic latent image. Further, a cleaning device 6 (6*a*, 6*b*, 6*c*, and 6*d*) is provided to remove a transfer residual toner remaining on the surface of the photosensitive drum 2 after a transfer.

The photosensitive drum 2, the charging device 3, the developing device 5, and the cleaning device 6 is integrated as a cartridge unit to form an image of different colors (yellow, cyan, magenta, and black colors) by a electrophotographic recording system, respectively.

A primary transfer roller 7 (7*a*, 7*b*, 7*c*, and 7*d*) is abutted on the photosensitive drum 2 through an intermediate transfer belt 8, and the toner image on the photosensitive drum 2 is transferred to the intermediate transfer belt 8. The intermediate transfer belt 8 is tensioned between a driving roller 9 and a tension roller 10 to rotate in counterclockwise direction by driving of the driving roller 9. A secondary transfer roller 11, which is provided at a position opposite to the driving roller 9 through the intermediate transfer belt 8, transfers the tonner image transferred to the intermediate transfer belt 8 to a sheet S. In addition, an intermediate transfer belt cleaning device 12 is provided at a position opposite to the tension roller 10 through the intermediate transfer belt 8 to remove and recover the transfer residual toner remaining on the surface of the intermediate transfer belt 8.

In order to feed and convey the sheet S, a sheet cassette 13, a multi-tray 17, and a pair of resister rollers 20 are provided to convey the sheet along a sheet conveying path 200. The sheet cassette 13 is provided at the lowermost portion of the image forming apparatus 1, and the multi-tray 17 is provided at a lower right of the apparatus to correct a skew feeding of the sheet S.

A fixing portion 21 fixes the toner image, which is formed on the sheet S through the intermediate transfer belt 8, by the image forming portion of each color.

A diverging point B is provided on the sheet conveying path 200, and a discharge conveying path 23 (first conveying path) and a reverse conveying path 26 (second conveying path) are provided to diverge into a downstream side in a conveying direction of the sheet S from this diverging point.

A double-side switching member 22 is a flapper-shaped member which is swingingly configured and is provided in the vicinity of the diverging point B. The double-side switching member 22 is waiting at a first position X which guides the sheet S to the discharge conveying path 23 during a normal state. In order to form the toner image on a second side of the sheet S, then, when a solenoid 50 to be described later is turned ON, the double-side switching member 22 is switched to a second position Y indicated by a dotted line portion of FIG. 3 so as to guide the sheet S to the reverse conveying path 26 side. As described above, the double-side switching member 22 is movable from the first position X to the second position Y.

A pair of discharge rollers 24 is a roller that discharges the sheet S to a discharge tray 25 acting as a sheet stacking portion.

Further, in order to form the toner image on the second side of the sheet S, a pair of reverse rollers 27, which switches back the sheet S, and a pair of double-side conveying rollers 28, 29, and 30, which again conveys the sheet to the pair of resister rollers 20, are equipped. In addition, a pre-discharge roller 31 (FIG. 2), in which a silicon sponge is covered with a PFA tube, is provided on the discharge conveying path 23 so as to prevent the image from being scratched when the sheet S is tensioned between the fixing portion 21 and the pair of discharge rollers 24.

Next, an operation of forming the image by the image forming apparatus 1 will be schematically described.

The predetermined number of sheets S stacked on the sheet cassette 13 is separated one by one by a feeding roller 14 and a separation roller 15 and is then conveyed to a feeding pull-out roller 16. In addition, the predetermined number of sheets S stacked on the multi-tray 17 is separated one by one by a multi-feeding roller 18 and a multi-separation roller 19 and is then conveyed to the feeding pull-out roller 16.

The sheet S conveyed by the feeding pull-out roller 16 is conveyed to the pair of resister rollers 20 to correct the skew feeding and is then conveyed to an abutting portion between the intermediate transfer belt 8 and the secondary transfer roller 11. The toner image transferred onto the intermediate transfer belt 8 from the image forming portion of each color is transferred onto the sheet S from the abutting portion between the intermediate transfer belt 8 and the secondary transfer roller 11 to form a color image, and then the sheet S is conveyed to the fixing portion 21.

The fixing portion 21 includes a fixing sleeve 21*a* as a heat source and a pressure roller 21*b* which is pressed against the fixing sleeve 21*a* to apply pressure to the sheet S, and heat and pressure are applied to the sheet S passing through the fixing portion 21, which is conveyed by the fixing portion 21. The sheet S, on which the toner image of plural colors is fixed, is guided to the double-side switching member 22 situated at the first position X by the fixing portion 21 to be guided to the discharge conveying path 23 side, then, is discharged to the discharge tray 25 through the pair of discharge rollers 24.

Figure 4:
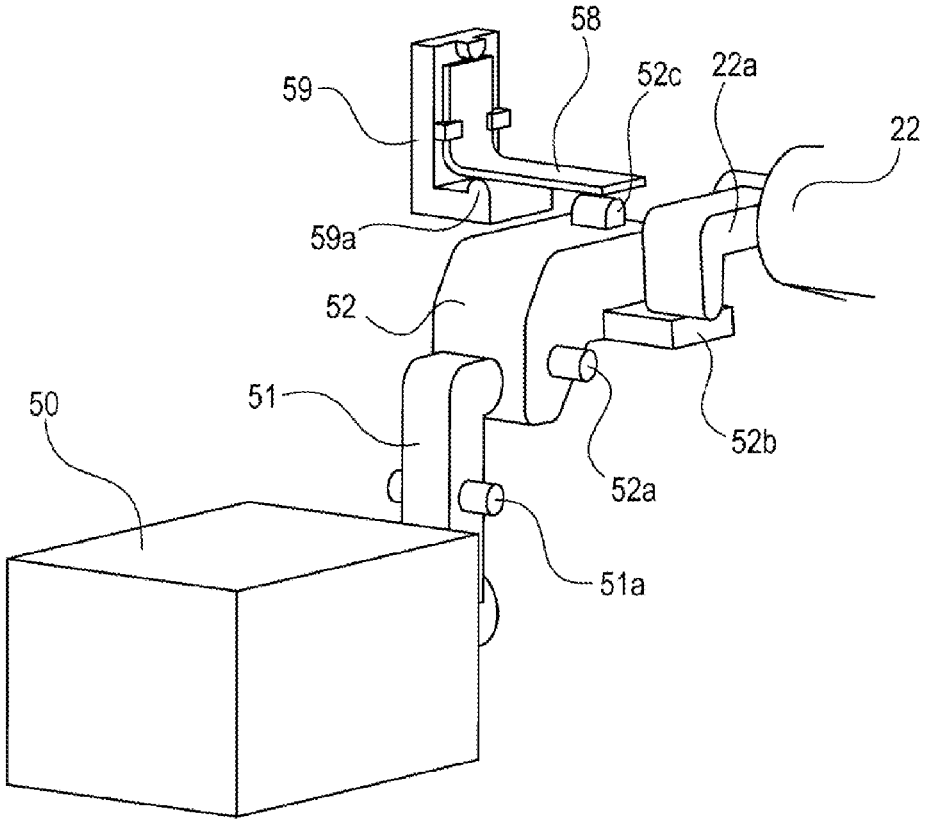
FIG. 4 is a diagram illustrating schematically a conveying path switching unit according to the first embodiment of the invention.

In addition, during a double-side printing, the double-side switching member 22 is switched to the second position Y guiding to the reverse conveying path 26 by turning-On the solenoid 50 (FIG. 4, details will be described later). The sheet S, in which the image is fixed on a first side by the fixing portion 21, is guided to the reverse conveying path 26 side by the double-side switching member 22 situated at the second position Y and is then conveyed to the pair of reverse rollers 27.

The double-side switching member 22 is switched to the first position X by turning-OFF the solenoid 50 when the trailing end of the sheet S passes through. The pair of reverse rollers 27 is reversed by receiving a signal from a controller (not illustrated) before the trailing end of the sheet S passes through the pair of reverse rollers 27. The sheet S passes through the reverse conveying path 26 by setting the trailing end of the sheet S to the leading position and is then conveyed to the pair of double-side conveying rollers 28. And then, the sheet S is conveyed to the pair of resister rollers 20 by each of the pair of double-side conveying rollers 29 and 30 by joining the conveying path from the sheet cassette 13 and the multi-tray 17.

Then, the image is formed on the second side of the sheet S through the intermediate transfer belt 8 and the secondary transfer roller 11. Then, the second side of the sheet S is fixed in the fixing portion 21, and the sheet S is guided to the discharge conveying path 23 side by the double-side switching member 22 situated at the first position X and is then discharged onto the discharge tray 25 by the pair of discharge rollers 24.

Figure 3:
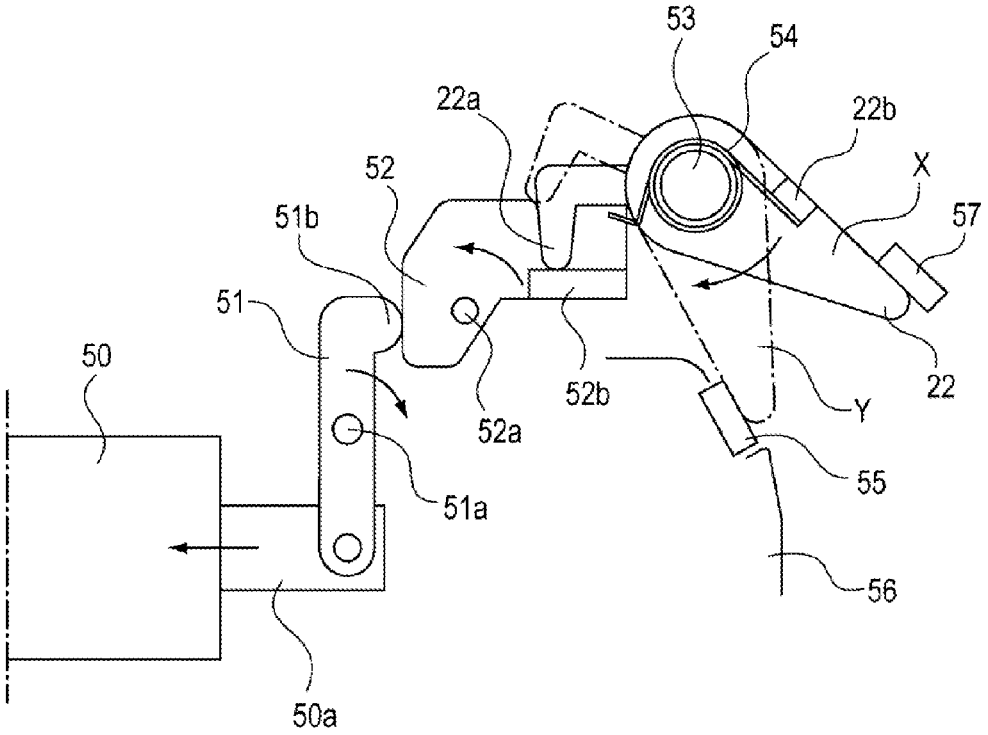
FIG. 3 is a diagram illustrating in detail a switching configuration of the double-side switching member according to the first embodiment of the invention.

(Switching Configuration of Switching Member) FIG. 3 is a diagram illustrating a detailed switching configuration of the double-side switching member 22 of the image forming apparatus 1 according to the first embodiment of the invention. The switching configuration of the conveying path will schematically be described with reference to FIG. 3. Each arrow in FIG. 3 indicates an operation direction of each configuration in the case in which the double-side switching member 22 is switched from the first position X to the second position Y.

The solenoid 50 is a driving portion, and incorporates one end of a plunger 50*a*. Moreover, the other end of the plunger 50*a* is pivotally supported on an arm 51. The arm 51 abuts on a connection plate 52 at a connection plate abutting portion 51*b*, and the connection plate 52 abuts on an arm portion 22*a* of the double-side switching member 22 at a switching member abutting portion 52*b*.

The double-side switching member 22 as a guide member moves from the first position X to the second position Y around a double-side switching member rotating shaft 53. A double-side switching member return spring 54 as a force applying portion to the first position X is configured in such a manner that one end of the arm is fixed to a return spring holding portion 22*b* of the double-side switching member 22 and the other end is fixed to a return spring holding portion (not illustrated) of the discharge conveying path 23, thereby pressing in a direction in which the double-side switching member 22 rotates toward the first position X. The pressing force of the double-side switching member return spring 54 is greater than a force to rotate toward the second position Y by its own weight of the double-side switching member 22.

A second position abutting portion 55 made of polone having excellent impact absorption is provided at a discharge conveying lower guide 56 constituting the discharge conveying path 23, and a first position abutting portion 57 made of polone is provided in a non-sheet passing area of a reverse conveying guide (not illustrated) constituting the reverse conveying path 26.

(Switching Operation between First Position and Second Position of Switching Member) Next, an operation when the double-side switching member 22 is switched from the first position X to the second position Y will be described.

First, a current is applied to the solenoid 50 by reception of an ON signal from the controller 71. Then, the plunger 50*a* is driven to the solenoid 50 side (left side in FIG. 3) such that the arm 51 is tensioned, and the arm 51 rotates in a clockwise direction around the arm rotating shaft 51*a*. When the connection plate abutting portion 51*b* of the arm 51 pushes the connection plate 52, the connection plate 52 rotates in a counterclockwise direction around a connection plate rotating shaft 52*a*, and the switching member abutting portion 52*b* of the connection plate 52 pushes up the arm portion 22*a* of the double-side switching member 22. Then, the double-side switching member 22 rotates to the second position Y around the double-side switching member rotating shaft 53, the switching operation is completed at the position where the leading end of the double-side switching member 22 abuts on the second position abutting portion 55.

On the other hand, when the double-side switching member 22 returns from the second position Y to the first position X, the current application to the solenoid 50 side is stopped by reception of an OFF signal from the controller 71. Then, a force to drive the plunger 50*a* to the solenoid 50 side is eliminated, and the double-side switching member 22 situated at the second position Y rotates in the counterclockwise direction by the force of the double-side switching member return spring 54. Then, the double-side switching member 22 rotates to the position where the leading end of double-side switching member 22 abuts on the first position abutting portion 57. According to the rotation, the connection plate 52 rotates in the clockwise direction, the arm 51 rotates in the counterclockwise direction, and the plunger 50*a* operates in a direction away from the solenoid 50, thereby returning to the state of FIG. 3.

It is assumed that the description of the operation from the first position X to the second position Y of the above-described double-side switching member 22 is the same as that of the schematic operation of the double-side switching member 22. In fact, as will be described below, the double-side switching member 22 moves through a third position Z.

(Switching Operation to Third Position of Switching Member) A switching operation of the double-side switching member 22 from the first position X to the second position Y and the third position Z will be described below.

FIG. 4 is a perspective view of the conveying path switching configuration in the image forming apparatus 1 according to the first embodiment. With reference to FIG. 4, a configuration for holding the double-side switching member 22 at the third position Z (illustrated in FIG. 7B) positioned between the first position X and the second position Y will be described.

As illustrated in FIG. 4, a plate spring 58 is provided as a holding portion, which temporarily holds, at the third position. The plate spring 58 is supported by a plate spring supporting member 59. Moreover, a plate spring biasing portion 59*a* is provided at the plate spring supporting member 59 to apply an appropriate biasing force to the plate spring 58. A plate spring abutting portion 52*c* of the connection plate 52 is disposed to come in contact with the plate spring 58 at a certain position.

Figure 5:
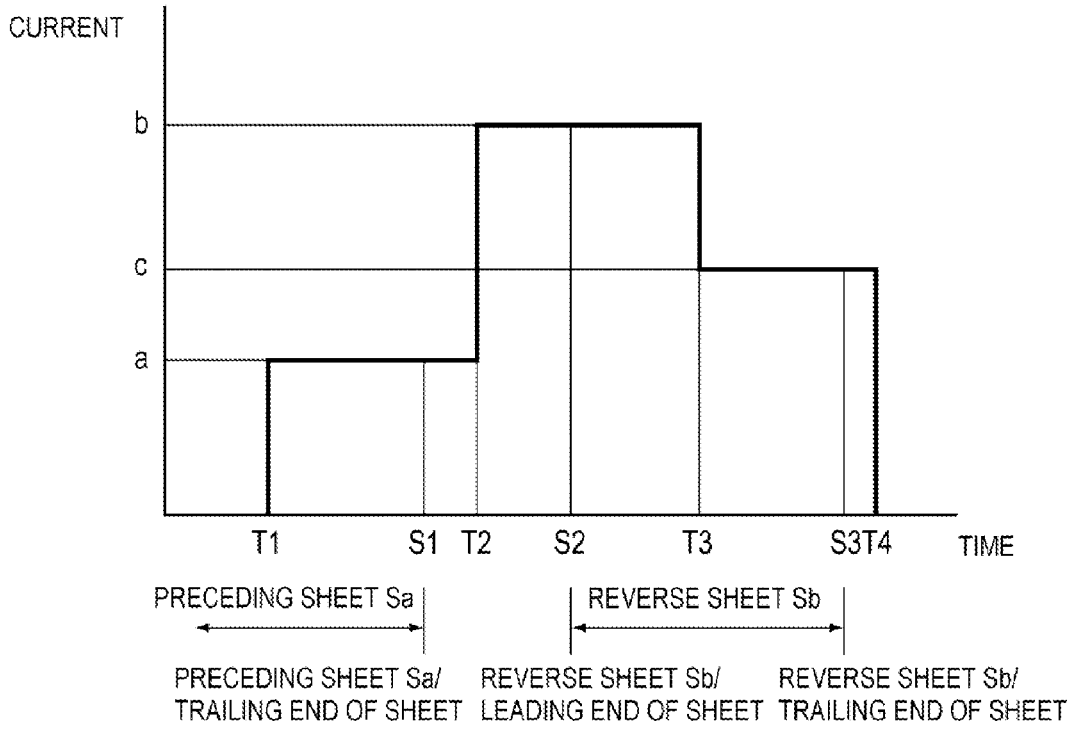
FIG. 5 is a graph illustrating a relation between a value of a current flowing in a solenoid according to the first embodiment of the invention and time.

FIG. 5 illustrates a relation between a current value to be applied to the solenoid 50 and time. In FIG. 5, the vertical axis represents the current value; the horizontal axis represents the time; and a lower side in FIG. 5 represents a time change in the present or absence of sheet at the tip portion of the double-side switching member 22. Further, the solenoid 50 pulses the current flowing therethrough to change a pulse period, thereby changing the force to operate the double-side switching member 22. A current-carrying control to the solenoid 50 is performed by the controller 71.

Each of points a, b, and c on the vertical axis of FIG. 5 indicates the current value to be applied to the solenoid 50 when the solenoid 50 receives the ON signal from the controller 71. T1 on the horizontal axis indicates the time at which the double-side switching member 22 starts to operate in the direction from the first position X to the third position Z, and T2 indicates the time at which the double-side switching member 22 starts to operate in the direction from the third position Z to the second position Y. T3 indicates the time required to reduce the current value flowing into the solenoid 50 so as to prevent a temperature rise of the solenoid 50, and T4 indicates the time at which the double-side switching member 22 starts to operate in the direction from the second position Y to the first position X when the solenoid 50 receives the OFF signal from the controller 71.

A preceding sheet Sa proceeds toward the discharge conveying path 23 (FIG. 2), and a trailing end sheet Sb moves toward the reverse conveying path 26 (FIG. 3). A trailing end S1 is a trailing end of the preceding sheet Sa, a leading end S2 is a leading end of the reversing sheet Sb, and time S3 is time when the trailing end of the reversing sheet passes through the tip portion of the double-side switching member 22.

Figure 6:
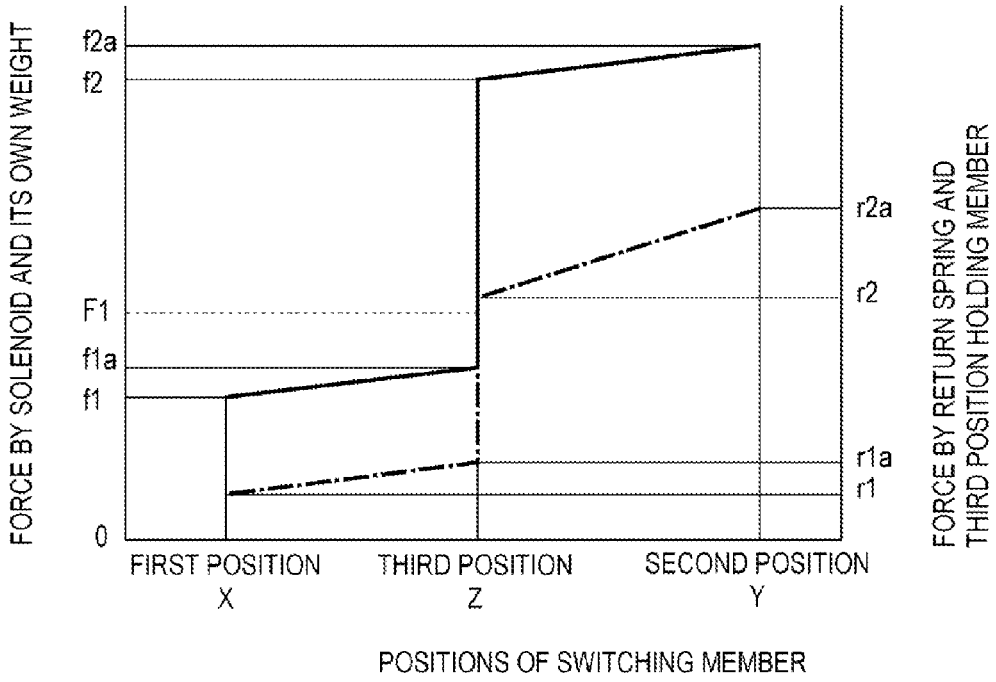
FIG. 6 is a graph illustrating a relation between a force to operate the double-side switching member in a second position and a force to operate the double-side switching member in a first direction in each position of the double-side switching member according to the first embodiment of the invention.

FIG. 6 is a diagram in which forces to rotate the double-side switching member 22 are summarized.

A solid line indicates the driving force caused by the solenoid 50 (FIG. 4) and the force by its own weight of the double-side switching member 22, which are forces to operate the double-side switching member 22 from the first position X to the third position Z and the second position Y. On the other hand, a dashed-dotted line indicates the force by the double-side switching member return spring 54 and the plate spring 58, which is a force to operate the double-side switching member 22 from the second position Y to the first position X.

A force f1 on the vertical axis indicates the sum of the driving force and the force by its own weight when a current value "a" is applied to the solenoid 50, and a force f1*a* indicates the sum of the force when the double-side switching member 22 moves to the third position Z at the current value "a" and the force by its own weight. Furthermore, since the solenoid 50 has the characteristics that the driving force rises when the stroke amount of the plunger 50*a* and the solenoid 50 is shorter, it satisfies the relation of f1 >f1*a*.

The sum of forces f2 is the sum of the driving force and the force by its own weight when a current value "b" is applied to the solenoid 50 at the third position Z, and the sum of forces f2*a* is the sum of the driving force and the force by its own weight when the current value "b" is applied to the solenoid 50 at the second position Y. A force r1 is a force by the double-side switching member return spring 54 (FIG. 5) at the first position X, and a force r1*a* is a force by the double-side switching member return spring 54 at the third position Z. The sum of forces r2 is the sum of the biasing force of the double-side switching member return spring 54 at the third position Z and the force by the load of the plate spring 58 (FIG. 5), and the sum of forces r2*a* is the sum of the force by the double-side switching member return spring 54 and the force by the plate spring 58 at the second position Y.

Figure 7A:
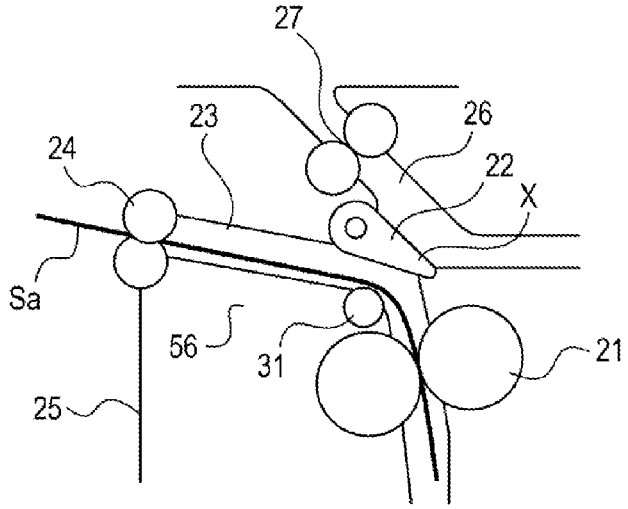
FIGS. 7A to 7C are diagrams illustrating a relation between a preceding sheet and a reversing sheet in each position of the double-side switching member according to the first embodiment of the invention.
Figure 7B:
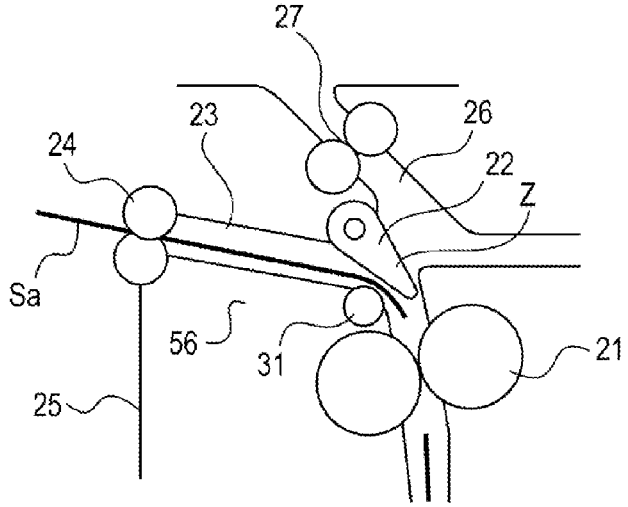
Figure 7C:
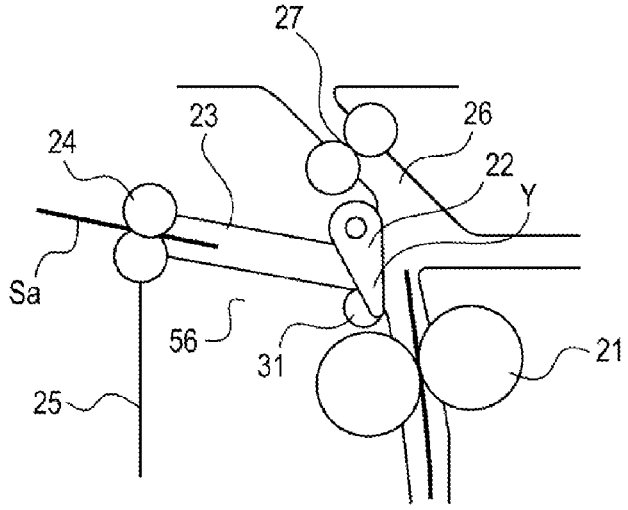

FIGS. 7A to 7C are diagrams illustrating states of the preceding sheet Sa and the reversing sheet Sb at each position of the double-side switching member 22. FIG. 7A illustrates the relation between the preceding sheet Sa and the reversing sheet Sb when the double-side switching member 22 is positioned at the first position X, FIG. 7B illustrates the relation between the preceding sheet Sa and the reversing sheet Sb when the double-side switching member 22 is positioned at the third position Z, and FIG. 7C illustrates the relation between the preceding sheet Sa and the reversing sheet Sb when the double-side switching member 22 is positioned at the second position Y.

Next, the state in which the preceding sheet Sa and the reversing sheet Sb are conveyed to the conveying path selected by the double-side switching member 22 will be described.

First, a case in which the double-side switching member 22 is rotatably moved from the first position X to the third position Z will be described. As illustrated in FIG. 7A, when the double-side switching member 22 is positioned at the first position X, the preceding sheet Sa conveyed by the fixing portion 21 passes through the discharge conveying path 23 and is then discharged to the discharge tray 25 through the pair of discharge rollers 24.

After the elapse of a certain time from the point where the leading end of the preceding sheet Sa passes through a sheet detecting sensor provided at a downstream side in a conveying direction of the fixing portion 21, a voltage is applied such that the current of the current value "a" (FIG. 5) flows through the solenoid 50 as the ON signal is received from the controller 71 at the time T1 (FIG. 5).

When the current of the current value "a" flows through the solenoid 50, the plunger 50*a* (FIG. 3) is driven into the solenoid 50 side. Thus, the resultant force f1 of the force to rotate the double-side switching member 22 in the clockwise direction (FIG. 3) through the arm 51 (FIG. 4) and the connection plate 52 (FIG. 4), and the force by its own weight of the double-side switching member 22 is applied to the double-side switching member 22. When the double-side switching member 22 is positioned at the first position X, the force r1 is a force to rotate the double-side switching member 22 in the counterclockwise direction by the double-side switching member return spring 54 (FIG. 3). At this time, since the relation of f1>r1 is set, the double-side switching member 22 starts to rotate in the clockwise direction.

Next, a case in which the double-side switching member 22 is held at the third position Z (FIG. 7B) will be described. At the third position Z, since the stroke amount of the plunger 50*a* is shortened, the force becomes the force f1*a* (FIG. 6) to cause the double-side switching member 22 to be rotated in the clockwise direction when the current of the solenoid 50 has the current value "a".

When the double-side switching member 22 is positioned at the third position Z, the plate spring abutting portion 52*c* (FIG. 4) of the connection plate 52 rotates in the counterclockwise direction around the connection plate rotating shaft 52*a* to abut on the plate spring 58 (FIG. 4). Here, the plate spring 58 is in a state in which a pressure is applied in advance by the plate spring biasing portion 59*a* (FIG. 4) of the plate spring supporting member 59. For this reason, when the plate spring abutting portion 52*c* of the connection plate 52 abuts on the plate spring 58, a force to rotate the connection plate 52 in the clockwise direction (a force to rotate the double-side switching member 22 in the counterclockwise direction) is generated. This force acts as a load against the driving force of the solenoid 50.

The force r2 to rotate the double-side switching member 22 in the counterclockwise direction is generated by joining the force r1*a* to rotate the double-side switching member 22 in the counterclockwise direction at the third position Z by the double-side switching member return spring 54 (FIG. 3) in addition to the force caused by the plate spring 58. Thus, the forces to rotate the double-side switching member 22 satisfy the relation of f1*a*<r2. Therefore, since the double-side switching member 22 is held at a state in which the plate spring abutting portion 52*c* of the connection plate 52 abuts on the plate spring 58 when the current value "a" flows through the solenoid 50, the double-side switching member 22 is held at the third position Z.

Further, as illustrated in FIG. 7B, the double-side switching member 22, which is held at the third position Z, is positioned so as not to press the preceding sheet Sa without causing the preceding sheet Sa to be interposed with the discharge conveying lower guide 56. For this reason, there is no occurrence of density unevenness of the image to be generated when the preceding sheet Sa is in contact with the double-side switching member 22 or the discharge conveying lower guide 56 immediately after the fixing. Further, in the state of FIG. 7A, since a conveying speed of the pair of discharge rollers 24 is faster than that of the fixing portion 21, the preceding sheet Sa is in the tensioned state between the fixing portion 21, the pre-discharge roller 31, and the pair of discharge rollers 24 and is out of contact with the guide portion of the discharge conveying path 23.

Next, a case in which the double-side switching member 22 rotates from the third position Z to the second position Y will be described. Until the time S1 (FIG. 5) at which the trailing end of the preceding sheet Sa passes through the tip portion of the double-side switching member 22, the double-side switching member 22 is held at the third position Z.

At the time T2 (FIG. 5) after the time S1 at which the sheet detecting sensor 72 provided at the downstream side in the conveying direction of the fixing portion 21 detects the trailing end of the preceding sheet Sa, the current value "b" (FIG. 5) flows through the solenoid 50 as the ON signal is received from the controller 71. When the current value "b" (FIG. 5) flows through the solenoid 50, the force to drive the plunger 50*a* into the solenoid 50 side increases, and the force to rotate the double-side switching member 22 in the clockwise direction becomes the resultant force f2 (FIG. 6) with the force by its own weight of the double-side switching member 22. The resultant force of the force to rotate the double-side switching member 22 in the counterclockwise direction by the double-side switching member return spring 54 (FIG. 3) and the plate spring 58 (FIG. 4) when the double-side switching member 22 is positioned at the third position Z is the resultant force r2 (FIG. 6) as described above.

The current value "b" is set such that the resultant force f2 to rotate the double-side switching member 22 in the clockwise direction satisfies the relation of f2>r2. When the relation of f2>r2 is satisfied, the plate spring abutting portion 52*c* of the connection plate 52, which is held by abutting on the plate spring 58, pushes up the plate spring 58 with a force greater than the pressure that is applied to the plate spring 58 in advance. In this way, the double-side switching member 22 starts to rotate in the clockwise direction.

The double-side switching member 22 is held at the second position Y (FIG. 7C) in the place where the double-side switching member 22 rotates in the clockwise direction from the third position Z to abut on the second position abutting portion 55 (FIG. 3). The force to rotate the double-side switching member 22 in the clockwise direction, with the current value "b" at the second position Y, since the stroke amount of the plunger 50*a* is shortened, increases to become the resultant force f2*a* (FIG. 6) with the force by its own weight of the double-side switching member 22. On the other hand, the resultant force r2*a* (FIG. 6) is the force to rotate the double-side switching member 22 in the counterclockwise direction by double-side switching member return spring 54 (FIG. 3) and the plate spring (FIG. 4) at the second position Y.

At this time, since the current value "b" is set such that the forces satisfy the relation of f2>r2*a*, the double-side switching member 22 is held at the second position Y. The leading end of the reversing sheet Sb reaches the tip portion of the double-side switching member 22 at the time S2 of FIG. 6 after completing the operation to the second position Y and is in a state illustrated in FIG. 7C.

In this manner, the double-side switching member 22 is switched to the third position Z in advance since the preceding sheet Sa passes through the double-side switching member 22 toward the discharge conveying path 23 side. By this, it is possible to quickly perform the switching up to the second position Y, compared to the operation of switching from the first position X to the second position Y at once. From the above, it is possible to shorten the distance between sheets while maintaining a status in which the preceding sheet Sa is out of contact with the double-side switching member 22.

Next, an operation after the double-side switching member 22 is switched to the second position Y will be described. A current value "c" (FIG. 5) is set in response to a temperature rise of the solenoid at the time T3 (FIG. 6) after the elapse of a certain time from the time S2 (FIG. 5) at which the leading end of the reversing sheet Sb reaches the tip portion of the double-side switching member 22. At this time, the current value "c" is set within the range in which the force to rotate the double-side switching member 22 in the clockwise direction (FIG. 7) is not less than the resultant force r2*a* (FIG. 6) of the force to rotate the double-side switching member 22 in the counterclockwise direction by the double-side switching member return spring 54 (FIG. 3) and the plate spring 58 (FIG. 4) at the second position Y.

Thereafter, when the sheet detecting sensor (not illustrated), which is provided at the downstream side in the conveying direction of the fixing portion 21, detects the trailing end of the reversing sheet Sb, the OFF signal is received from the controller 71 at the time T4 (FIG. 5) after the elapse of a certain time from the time S3 (FIG. 5) at which the trailing end of the reversing sheet Sb passes through the tip portion of the double-side switching member 22. Thus, the application of current to the solenoid 50 is stopped. Then, the force to drive the plunger 50*a* (FIG. 3) by the solenoid 50 becomes zero, and the double-side switching member 22 positioned at the second position Y rotates in the counterclockwise direction due to the force of the double-side switching member return spring 54 and the plate spring 58 (FIG. 4). Further, the double-side switching member 22 is held at the first position X by abutting the leading end of double-side switching member 22 on the first position abutting portion 57 (FIG. 3).

Furthermore, the force to rotate the double-side switching member 22 in the counterclockwise direction by the double-side switching member return spring 54 and the plate spring 58 is illustrated as a vertically standing shape at the third position Z of the graph of FIG. 6. That is, the third position Z is constantly positioned for the period in which a press force does not exceed the force r2 after the plate spring abutting portion 52*c* of the connection plate 52 abuts on the plate spring 58. Therefore, even though the force applied to the double-side switching member 22 is varied in some degree by variation of the driving force of the solenoid 50, the double-side switching member 22 can be exactly positioned at the third position Z.

For example, even when the force applied to the double-side switching member 22 is varied from the force f1*a* to the force F1 (FIG. 6) due to the variation of the driving force of the solenoid 50, the double-side switching member 22 can be exactly positioned at the third position Z.

Figure 8:
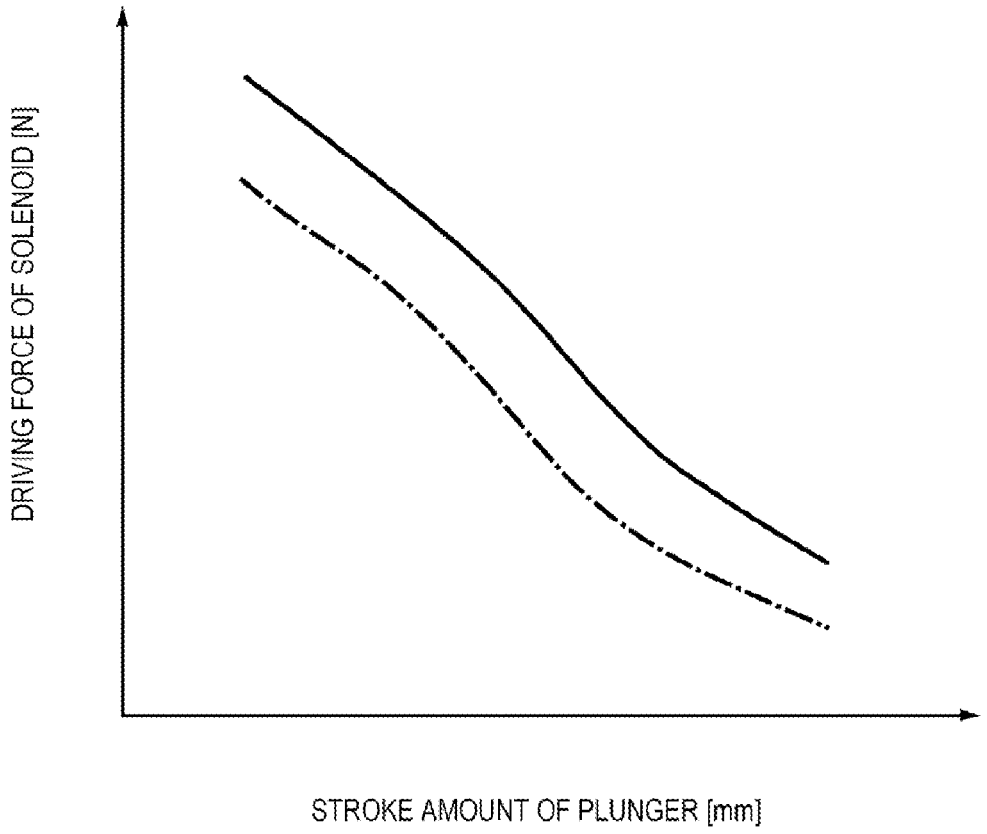
FIG. 8 is a graph illustrating a relation between a stroke amount and a driving force of an actuator of the solenoid according to the first embodiment of the invention.

FIG. 8 is a diagram illustrating an example of a relation between the driving force of the solenoid 50 and the stroke amount of the plunger 50*a*. In FIG. 8, a solid line illustrates the driving force when the current value applied to the solenoid 50 is high, and a dotted line illustrates the driving force when the current value applied to the solenoid 50 is low.

In the ratio of the current value applied to the solenoid 50, the current value "a" (FIG. 5) is 45% when the current value "b" (FIG. 5) is 100%. In the case of the current value "a", when the double-side switching member 22 is positioned at the first position X, the driving force to attract the plunger 50*a* by the solenoid 50 becomes 75 gf. In the case of the current value "b", when the double-side switching member 22 is positioned at the third position Z, since the current value increases and the stroke amount is shorten, the driving force is 180 gf. In this case, when the double-side switching member 22 is positioned at the second position Y, the current value is constant, but the stroke amount is shorten. Accordingly, the driving force is 210 gf. These driving force become the force to rotate the double-side switching member 22 through the arm 51 and the connection plate 52. In addition, the force by its own weight of the double-side switching member 22 is 22 gf.

In addition, the pressure, which is applied to the plate spring 58 in advance, is 25 g, the force of the plate spring 58 is 35 g when the double-side switching member 22 is positioned at the second position Y, and the pressure of the double-side switching member return spring 54 is 30 g, 35 g, and 45 g at the first position X, the third position Z, and the second position Y, respectively.

When the above-described forces are applied to each configuration, moments applied to the double-side switching member 22 around the double-side switching member rotating shaft 53 are that the force f1 is 280 gf·mm and the force r1 is 175 gf·mm at the first position X to satisfy the relation of f1>r1, and thereby the double-side switching member 22 starts to rotate in the direction of the second position Y.

In addition, when the double-side switching member 22 is held at the third position Z, the force f1*a* is 290 gf·mm and the force r2 is 350 gf·mm to satisfy the relation of f1*a*<r2, and thus the double-side switching member 22 is held at the third position Z. When the double-side switching member 22 starts to operate from the third position Z to the second position Y, the force f2 is 460 gf·mm and the force r2 is 350 gf·mm without being changed to satisfy the relation of f2>r2, and thus the double-side switching member 22 starts to rotate. When the double-side switching member 22 abuts on the second position abutting portion 55, the force f2*a* is 575 gf·mm and the force r2*a* is 448 gf·mm to satisfy the relation of f2*a*>r2*a*, and thus the double-side switching member 22 is held at second position Y.

Further, since the values described above are intended to illustrate one example that implements the first embodiment, values for implementing the first embodiment are not limited to these values.

Incidentally, the first embodiment is configured such that the plate spring 58 is used as a third position holding member, but may be configured such that a constant pressure is applied to other force applying portions such as a compression spring, tension spring, or torsion coil spring in advance.

The above-described embodiment describes an example in which the its own weight of the double-side switching member 22 acts so as to apply a force of the double-side switching member 22 from the first position X to the direction of the second position Y. However, it may be configured such that the double-side switching member 22 acts from the second position Y to the first position X by its own weight. In this case, its own weight acts in a direction to reduce the driving force. Furthermore, in the configuration in which the conveying path is diverged in the horizontal direction and the double-side switching member 22 rotates in a right-and-left direction, its own weight is not loaded on the driving force.

[Second Embodiment] Another embodiment of the invention will be described below with reference to FIGS. 9 to 11. A configuration of an image forming apparatus in the second embodiment is the same as that in the first embodiment, and the same or similar components as those in the first embodiment are denoted by the same reference numerals and the repeated description will not be presented. Hereinafter, parts different from the first embodiment will be mainly described.

Figure 9:
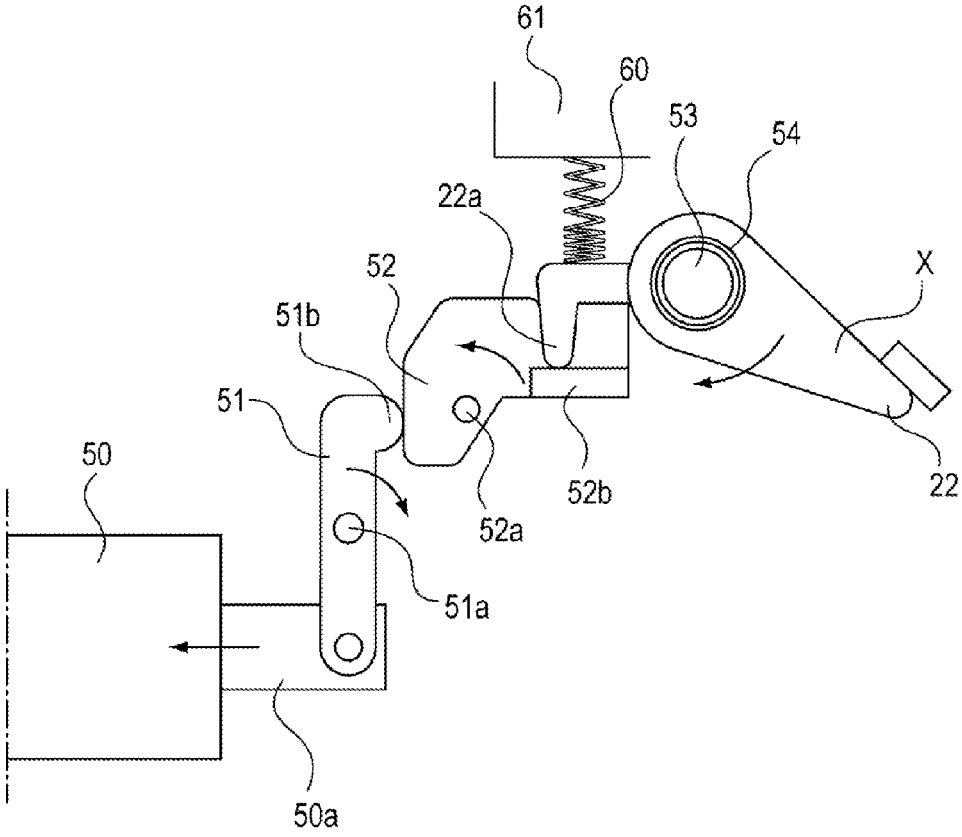
FIG. 9 is a diagram illustrating a schematic configuration a conveying path switching mechanism according to a second embodiment of the invention.

FIG. 9 is a diagram illustrating a detailed switching configuration of the double-side switching member 22 of the image forming apparatus 1 according to the second embodiment. A switching member return compression spring 60 is an unequal pitch spring, and a pitch is different in the middle of spring. A compression spring holding portion 61 is provided in a part of the sheet guide portion of the reverse conveying path 26 (FIGS. 7A to 7C) to hold the switching member return compression spring 60.

Arrows in FIG. 9 illustrate operational directions when the force to rotate the double-side switching member 22 in the clockwise direction is applied in the case in which the current flows through the solenoid 50.

When the voltage is applied and the current flows to/through the solenoid 50, the force to rotate the double-side switching member 22 in the clockwise direction to the arm portion 22*a* of the double-side switching member 22 through the plunger 50*a*, the arm 51, and the connection plate 52 is generated. The switching member return compression spring 60 acting as an unequal pitch spring is pressed against the arm portion 22*a* of the double-side switching member 22 in the direction to rotate the double-side switching member 22 in the counterclockwise direction. Further, the other end of the switching member return compression spring 60 is fixed to the compression spring holding portion 61 provided in the reverse conveying path 26.

Figure 10:
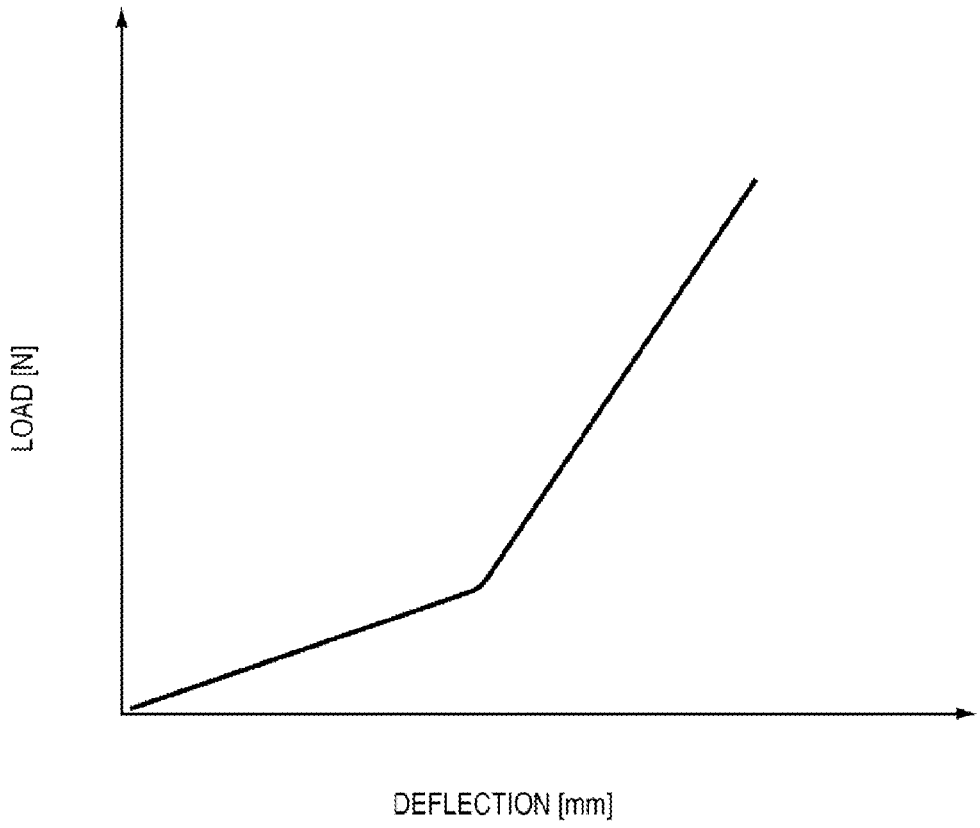
FIG. 10 is a graph illustrating a relation between a deflection amount and a load of an unequal pitch spring according to the second embodiment of the invention.

FIG. 10 illustrates a relation between a load and a deflection of the switching member return compression spring 60 acting as the unequal pitch spring. In this unequal pitch spring, since the number of effective turns acting as a spring is changed when the load is applied to the spring, the unequal pitch spring has a non-linear characteristic as illustrated in FIG. 10.

Figure 11:
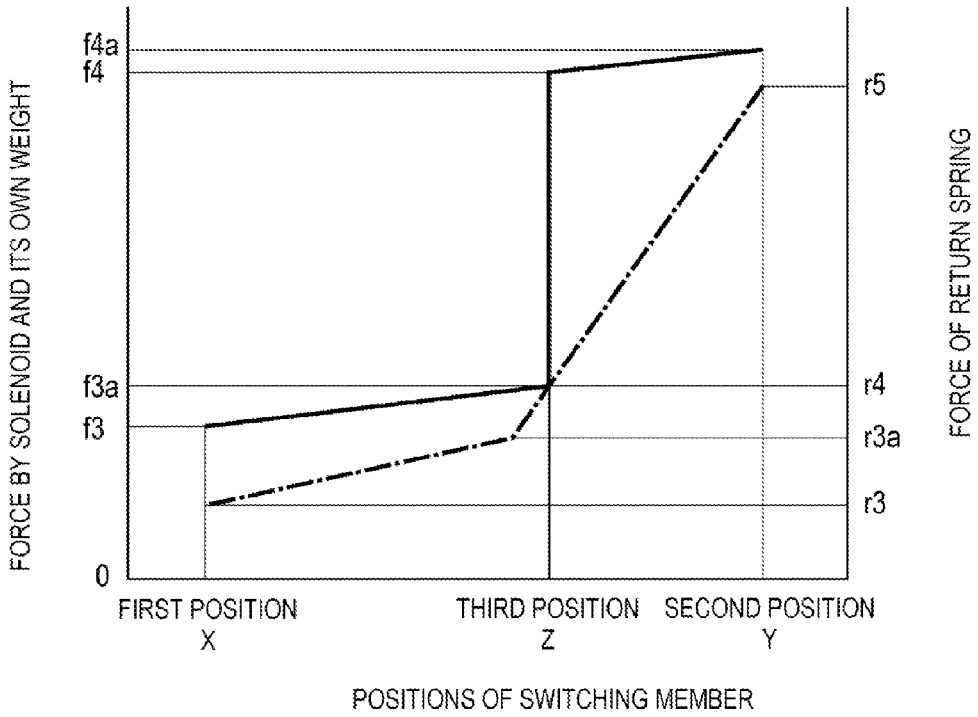
FIG. 11 is a graph illustrating a relation between a force to operate the double-side switching member in a second position and a force to operate the double-side switching member in a first direction in each position of the double-side switching member according to the second embodiment of the invention.

FIG. 11 is a diagram in which forces to rotate the double-side switching member 22 during a conveying path switching according to the second embodiment are summarized. A solid line indicates a driving force caused by the solenoid 50 (FIG. 9) and a force by its own weight of the double-side switching member 22, which are forces to operate the double-side switching member 22 from the first position X (FIGS. 7A to 7C) to the third position Z and the second position Y. On the other hand, a dashed-dotted line indicates a force by the switching member return compression spring 60, which is a force to operate the double-side switching member 22 from the second position Y to the first position X.

The current value and timing for applying the current to the solenoid 50 are the same as those in the first embodiment. In FIG. 11, a force f3 indicates the sum of forces due to the solenoid 50 and its own weight of the double-side switching member 22 when the current value "a" is applied at the first position X, a force f3*a* indicates the sum of forces due to the solenoid 50 and its own weight of the double-side switching member 22 when the current value "a" is applied at the third position Z, a force f4 indicates the sum of forces due to the solenoid 50 and its own weight of the double-side switching member 22 when the current value "b" is applied at the third position Z, and a force f4*a* indicates the sum of forces due to the solenoid 50 and its own weight of the double-side switching member 22 when the current value "b" is applied at the second position Y. A force r3 indicates a force by the switching member return compression spring 60 at the first position X, a force r3*a* indicates a force by the switching member return compression spring 60 when a spring constant is changed by the change of the number of effective turns of the switching member return compression spring 60, a force r4 indicates a force by the switching member return compression spring 60 at the third position Z, and a force r5 indicates a force by the switching member return compression spring 60 at the second position Y.

Next, the relation between the forces to operate the double-side switching member 22 will be described with reference to FIG. 11. When the current value "a" (FIG. 5) flows through the solenoid 50 at the first position X, since the relation of f3>r3 is satisfied as illustrated in FIG. 11, the double-side switching member 22 starts to rotate in the clockwise direction. Thereafter, when the force reaches the force r3*a* by compressing a certain amount of the switching member return compression spring 60 (FIG. 9), the spring constant is higher by the change of the number of effective turns. When the switching member return compression spring 60 is further compressed, the relation of f3*a*=r4 is satisfied, and thus the double-side switching member 22 is held at the third position Z. Thereafter, when the current value "b" flows through the solenoid 50, the relation of f4>r4 is satisfied, and thus the double-side switching member 22 starts to rotate to the second position Y. When the double-side switching member 22 abuts on the second position abutting portion 55 (FIG. 3), since the relation of f4*a*>r5 is satisfied, the double-side switching member 22 is held at the second position Y.

When the double-side switching member 22 returns to the first position X, the switching operation thereof is completed by stopping the application of the current to the solenoid 50 and by abutting the double-side switching member 22 on the first position abutting portion 57 (FIG. 3) with the force of the switching member return compression spring 60.

According to the second embodiment, it is possible to realize the effect, which is obtained by the double-side switching member return spring 54 (FIG. 3) and the plate spring 58 (FIG. 4) of the first embodiment, by a single component using the switching member return compression spring 60 acting as the unequal pitch spring having the non-linear characteristic.

Figure 12:
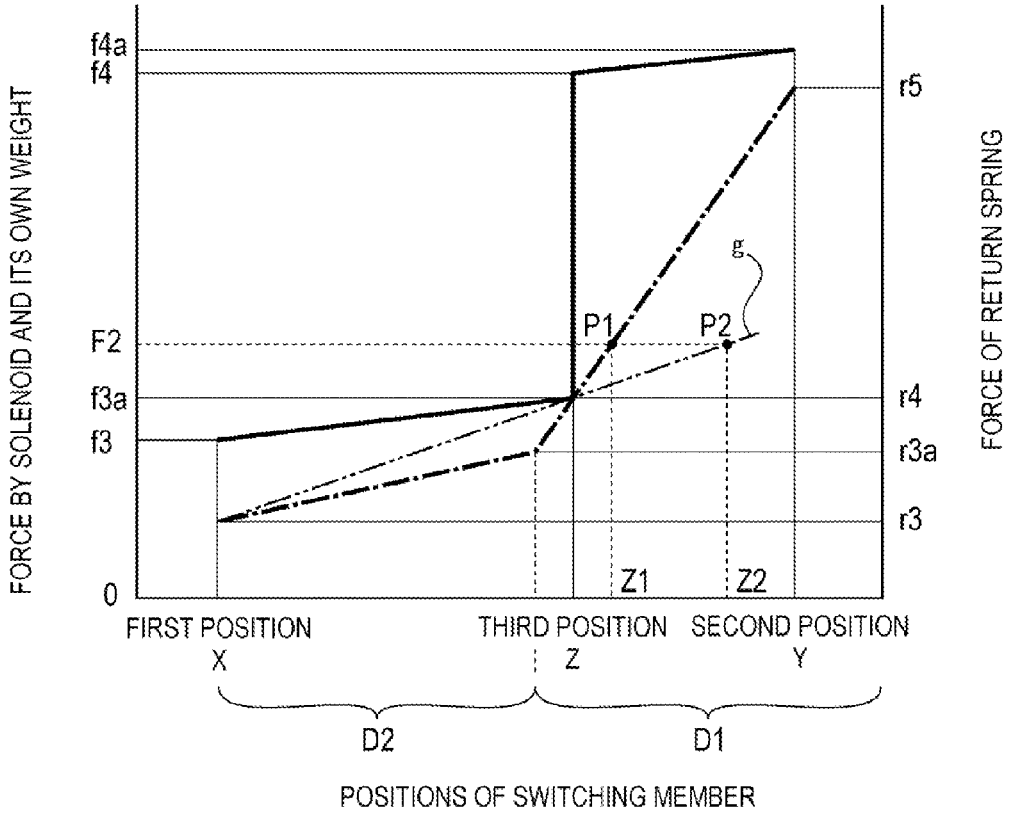
FIG. 12 is a graph illustrating a difference in effects between a case in which a switching member return compression spring according to the second embodiment of the invention has a linear characteristic and a case in which the switching member return compression spring has a non-linear characteristic.

FIG. 12 is a graph illustrating effect in the case in which the switching member return compression spring 60 has the non-linear characteristic in relation to a case in which the switching member return compression spring 60 has a linear characteristic. In FIG. 12, a two-dot chain line "g" indicates the relation between a displacement and a force applied to the switching member return compression spring 60 in the case in which the switching member return compression spring 60 has the linear characteristic.

In the second embodiment, the third position Z becomes a position where the force f3*a* and the force r4 are balanced. Therefore, when variation occurs in the driving force of the solenoid 50, the spring having the non-linear characteristic in which an angle formed with the horizontal axis is large (spring constant is large) in the vicinity of the third position Z is smaller in the positional deviation of the third position Z than the spring having the linear characteristic in which an angle formed with the horizontal axis is small (spring constant is small). In the second embodiment, that is, the spring having the non-linear characteristic, which is configured such that the spring constant of a predetermined region D1 including the third position Z becomes larger than that of another region D2, is used as the switching member return compression spring 60.

In FIG. 12, for example, when the driving force F2 applied instead of the force f3*a* due to the variation of the driving force of the solenoid 50, the balanced position becomes a point P2 in the case of the spring having the linear characteristic. At this time, a position Z2 becomes the third position Z, whereas the balanced position becomes a point P1 in the case of the spring having the non-linear characteristic, and thus a position Z1 smaller in fluctuation than the position Z2 becomes the third position Z. Therefore, the double-side switching member 22 is exactly positioned at the third position Z.

In the second embodiment, the unequal pitch spring is used as the switching member return compression spring 60, but the spring having the non-linear characteristic, for example, a conical spring and the like may be used.

[Third Embodiment] Next, further another embodiment of the invention will be described with reference to FIGS. 13 to 16. A configuration of an image forming apparatus in a third embodiment is the same as that in the first embodiment, and the same or similar components as those in the first embodiment are denoted by the same reference numerals and the repeated description will not be presented. Hereinafter, parts different from the first embodiment will be mainly described.

Figure 13:
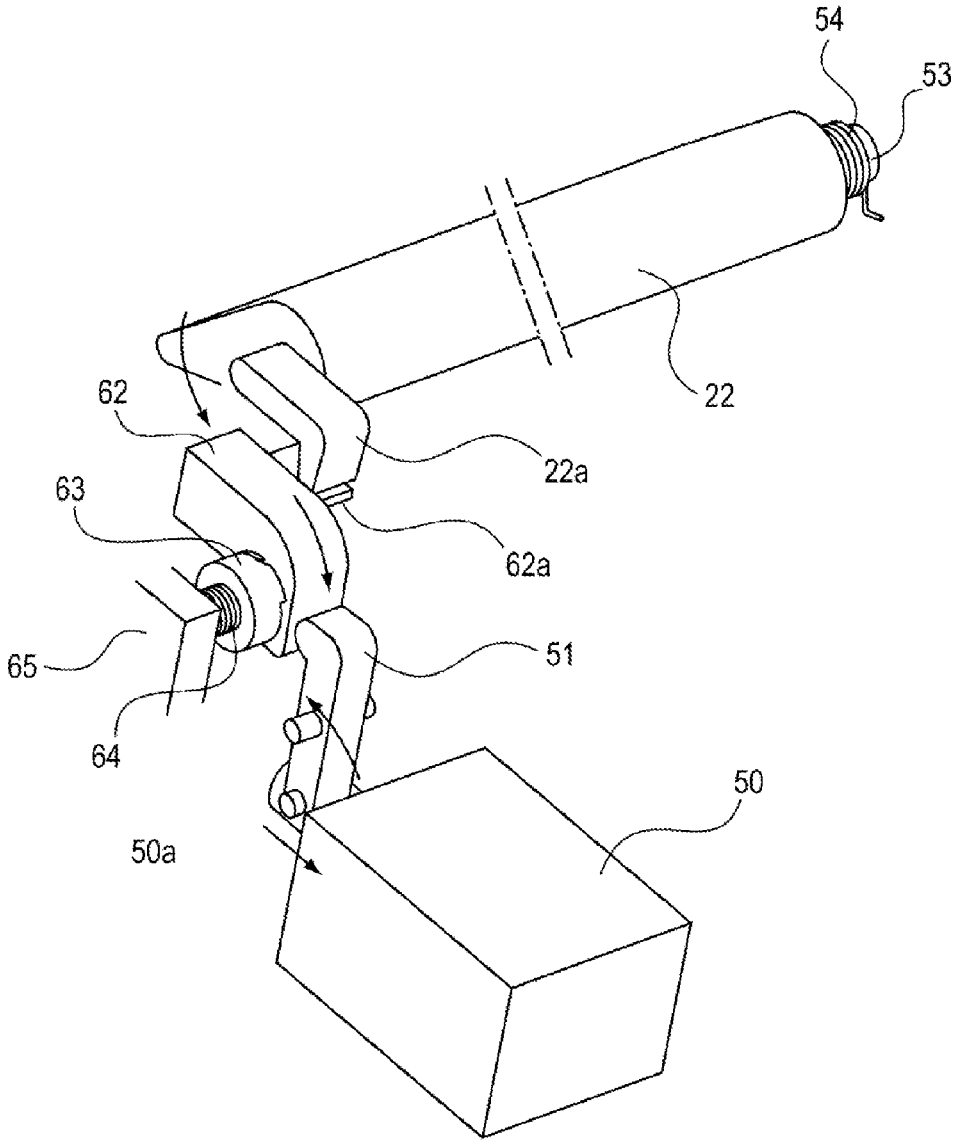
FIG. 13 is a diagram illustrating a schematic configuration of a conveying path switching mechanism according to a third embodiment of the invention.

FIG. 13 is a diagram illustrating a detailed switching configuration of the double-side switching member 22 according to a third embodiment.

A switching member abutting portion 62*a* of a cam-attached connection plate 62 abuts on the arm portion 22*a* of the double-side switching member 22. A cam 63 (cam-shaped member) is pressed against the cam-attached connection plate 62 side by a cam pressure spring 64. In addition, the cam pressure spring 64 is held by a pressure spring holding portion 65. Further, the cam-attached connection plate 62 and the cam 63 is a state formed by coating grease on a polyacetal resin having small sliding resistance, and the sliding resistance of the cam-attached connection plate 62 and the cam 63 is so small as to be negligible. Arrows in FIG. 13 indicate directions of forces when the force to rotate in a direction to move the double-side switching member 22 from the first position X to the third position Z is applied in the case in which the current flows through the solenoid 50.

Figure 14A:
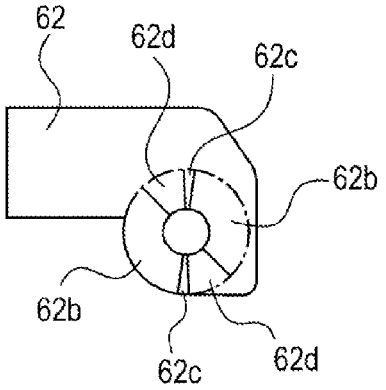
FIGS. 14A to 14C are diagrams illustrating a shape of a cam according to the third embodiment of the invention.
Figure 14B:
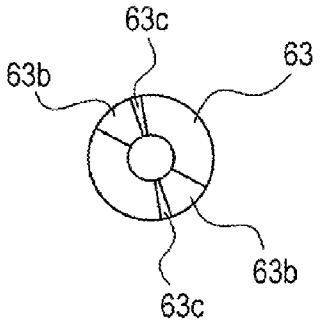
Figure 14C:
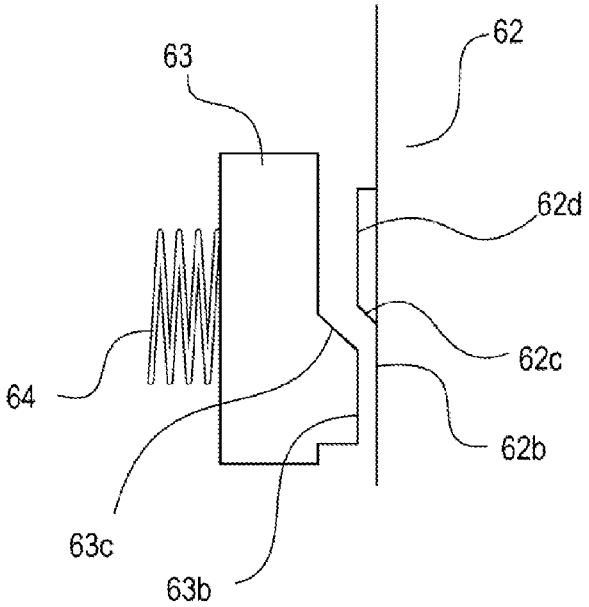

FIGS. 14A to 14C are diagrams illustrating a detailed diagram (FIG. 14A) of the cam-attached connection plate 62, a detailed diagram (FIG. 14B) of the cam 63, a schematic diagram (FIG. 14C) illustrating a relation between the cam-attached connection plate 62 and the cam 63.

As illustrated in FIG. 14C, when the double-side switching member 22 is positioned at the first position X, the cam-attached connection plate 62 includes a first position contacting portion 62*b* which comes in contact with the cam 63. In addition, when the double-side switching member 22 is positioned at the third position Z, the cam-attached connection plate 62 includes a third position contacting portion 62*c* which comes in contact with the cam 63. Moreover, when the double-side switching member 22 is positioned at the second position Y, the cam-attached connection plate 62 includes a second position contacting portion 62*d* which comes in contact with the cam 63. Furthermore, the second position contacting portion 62*d* is a face that is protruded in a convex shape from the surface of the first position contacting portion 62*b*. In addition, the third position contacting portion 62*c* has an inclined-plane shape that is continuously formed from the surface of the first position contacting portion 62*b* to the surface of the second position contacting portion 62*d*.

As illustrated in FIG. 14A, those having the same shape as the first position contacting portion 62*b*, the third position contacting portion 62*c*, and the second position contacting portion 62*d* are provided at a position rotated by 180°. That is, the first position contacting portions 62*b*, the third position contacting portions 62*c*, and the second position contacting portions 62*d* are provided in pairs at positions opposite to each other.

As illustrated in FIG. 14C, the cam 63 side is provided with a contacting portion 63*b*, which comes in contact with the first position contacting portion 62*b* and the second position contacting portion 62*d* of the cam-attached connection plate 62 when the double-side switching member 22 is positioned at the first position X and the second position Y, and a contacting portion 63*c* of the inclined-plane shape, which comes in contact with the third position contacting portion 62*c* of the cam-attached connection plate 62 when the double-side switching member 22 is positioned at the third position Z. Similar to the connection plate 62, as illustrated in FIG. 14B, those having the same shape as the contacting portions 63*b* and 63*c* are provided at a position rotated by 180° even in the cam 63.

Figure 15A:
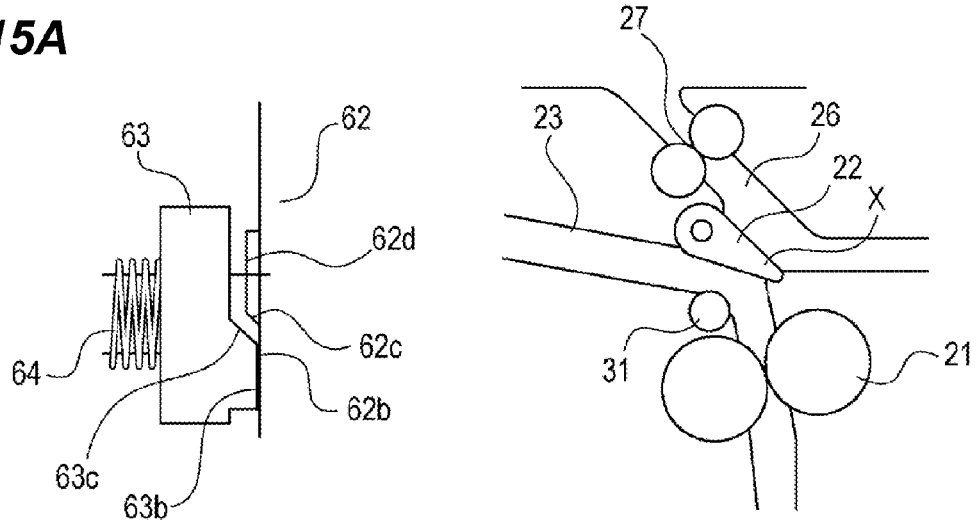
FIGS. 15A to 15C are diagrams illustrating a relation between the cams in each position of the double-side switching member according to the third embodiment of the invention.
Figure 15B:
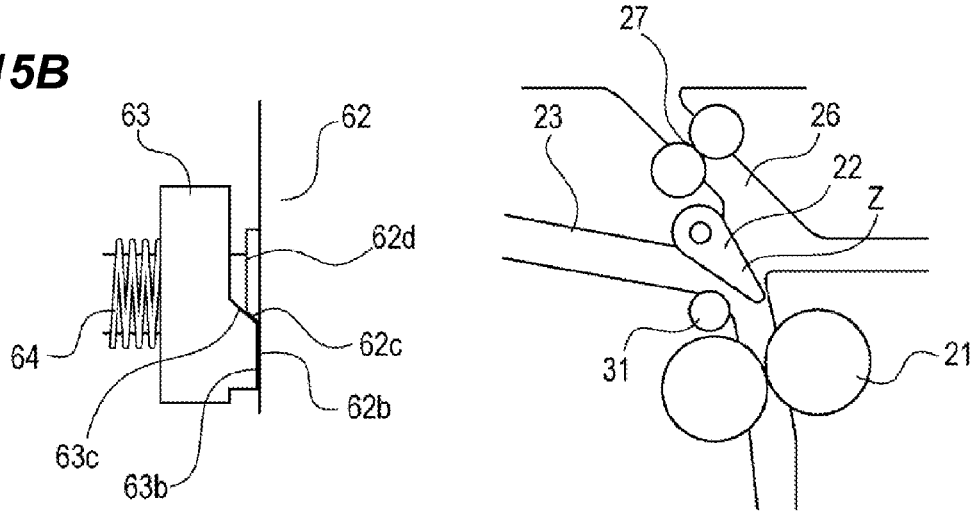
Figure 15C:
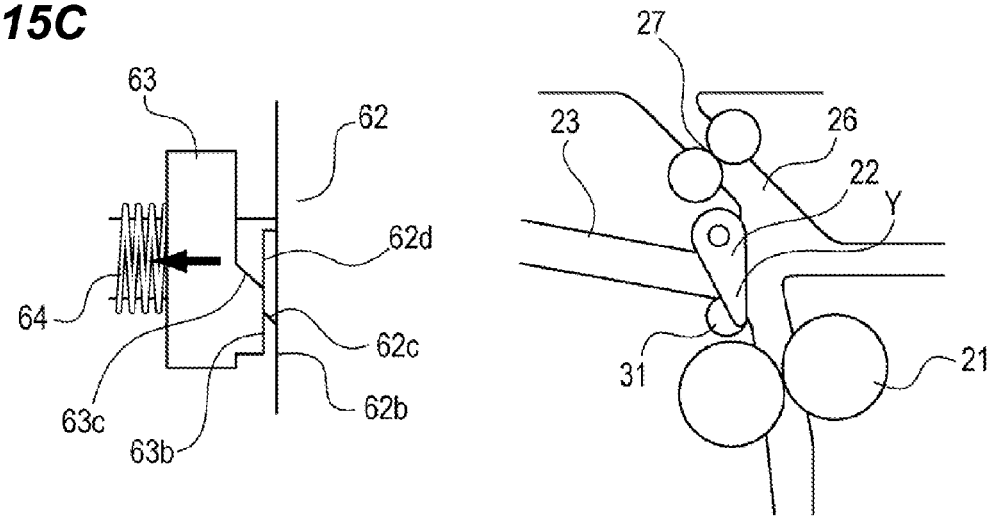

FIGS. 15A to 15C are diagrams illustrating a relation between the cam-attached connection plate 62 and the cam 63 when the double-side switching member 22 is positioned at the first position X (FIG. 15A), at the third position Z (FIG. 15B), and at the second position Y (FIG. 15C), respectively. Further, those having the same shape as the cam-attached connection plate 62 and the cam 63 are disposed at a position rotated by 180°, but only one cam-attached connection plate 62 and cam 63 are displayed for simplicity.

Figure 16:
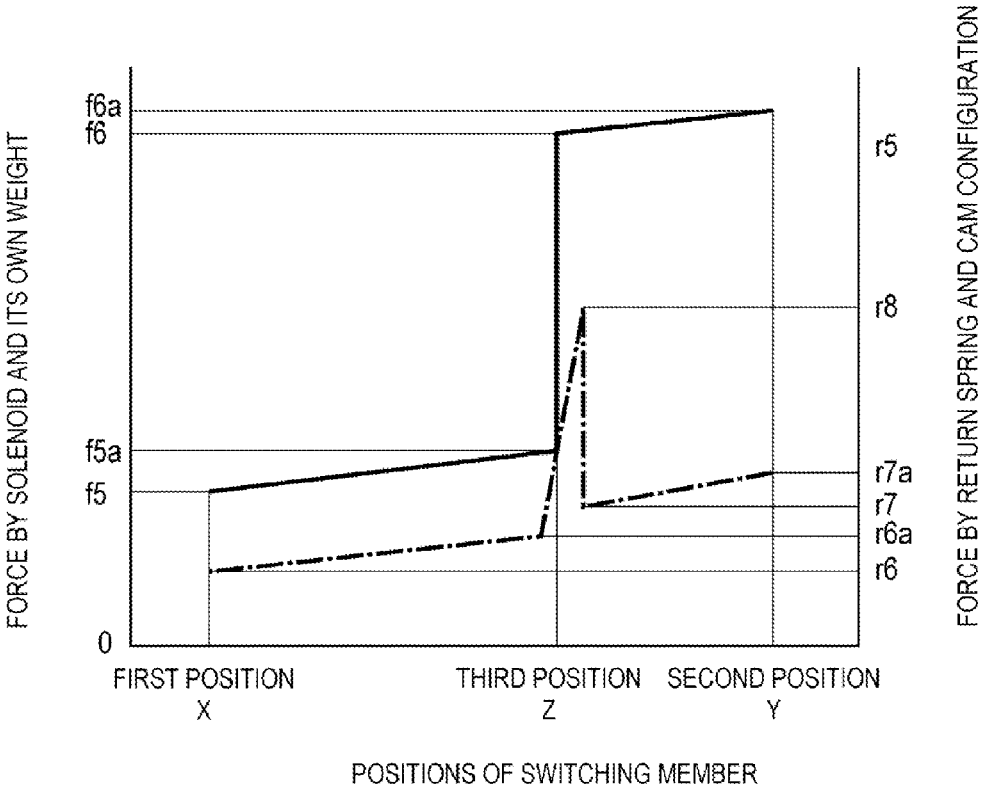
FIG. 16 is a graph illustrating a relation between a force to operate the double-side switching member in a second position and a force to operate the double-side switching member in a first direction in each position of the double-side switching member according to the third embodiment of the invention.

FIG. 16 is a diagram in which forces to rotate the double-side switching member 22 during a conveying path switching according to the third embodiment are summarized. A solid line indicates a driving force caused by the solenoid 50 (FIG. 13) and a force by its own weight of the double-side switching member 22, which are forces to operate the double-side switching member 22 from the first position X to the third position Z and the second position Y. On the other hand, a dashed-dotted line indicates a force by the double-side switching member return spring 54, which is a force to operate the double-side switching member 22 from the second position Y to the first position X.

The current value and timing for applying the current to the solenoid 50 are the same as those in the first embodiment and are performed as illustrated in FIG. 5. A force f5 indicates the sum of forces due to the driving force of the solenoid 50 and its own weight of the double-side switching member 22 when the current value "a" (FIG. 5) is applied at the first position X, a force f5*a* indicates the sum of forces due to the driving force of the solenoid 50 and its own weight of the double-side switching member 22 when the current value "a" is applied at the third position Z, a force f6 indicates the sum of forces due to the driving force of the solenoid 50 and its own weight of the double-side switching member 22 when the current value "b" is applied at the third position Z, and a force f6a indicates the sum of forces due to the driving force of the solenoid 50 and its own weight of the double-side switching member 22 when the current value "b" is applied at the second position Y.

A force r6 indicates a force by the double-side switching member return spring 54 at a position immediately before the third position contacting portion 62*c* of the cam-attached connection plate 62 and the contacting portion 63*c* of the cam 63 start to come in contact with each other when the double-side switching member 22 is positioned at the first position X, and a force r6*a* indicates a force indicates a force by the double-side switching member return spring 54 at a position immediately before the third position contacting portion 62*c* of the cam-attached connection plate 62 and the contacting portion 63*c* of the cam 63 start to come in contact with each other when the double-side switching member 22 is positioned at the third position Z.

A force r7 indicates a force by the double-side switching member return spring 54 at a position where the second position contacting portion 62*d* of the cam-attached connection plate 62 and the contacting portion 63*b* of the cam 63 start to come in contact with each other when the double-side switching member 22 is positioned at the third position Z. A force r7a indicates a force by the double-side switching member return spring 54 when the double-side switching member 22 is positioned at the second position Y.

A force r8 indicates the sum of the force of the double-side switching member return spring 54 and a force to press the cam pressure spring 64 of a state immediately before the contacting portion 63*b* of the cam 63 and the second position contacting portion 62*d* of the cam-attached connection plate 62 come in contact with each other at the state in which the contacting portion 63*c* of the cam 63 and the third position contacting portion 62*c* of the cam-attached connection plate 62 come in contact with each other.

Next, an operation of the double-side switching member 22 according to the third embodiment will be described with reference to FIGS. 15A to 15C and FIG. 16.

In the case in which the double-side switching member 22 is positioned at the first position X, when the current value "a" (FIG. 5) flows though the solenoid 50, as illustrated in FIG. 16, since the relation of f5>r6 is satisfied, the double-side switching member 22 starts to rotate in the clockwise direction. At this time, as illustrated in FIG. 15A, the first position contacting portion 62*b* of the cam-attached connection plate 62 and the contacting portion 63*b* of the cam 63 are in a contact state.

Thereafter, as illustrated in FIG. 15B, the double-side switching member 22 rotates, and the third position contacting portion 62*c* of the cam-attached connection plate 62 and the contacting portion 63*c* of the cam 63 abut on each other. Further, at this time, the inclined-plane shape of the third position contacting portion 62*c* of the cam-attached connection plate 62 comes in contact with the inclined-plane shape of the contacting portion 63*c* of the cam 63.

After the cam portion is in the state of FIG. 15B, when the double-side switching member 22 further rotates in the clockwise direction, the third position contacting portion 62*c* of the cam-attached connection plate 62 requires the force to move the cam 63 to the left side in FIG. 15B with the force greater than the force to press the cam against the right side in FIG. 15B by the cam 63 pressure spring 64. When the force applied to the double-side switching member 22 is greater than the force f5*a* but is less than the force r8, the double-side switching member 22 is held at the third position Z.

Thereafter, when the current value "b" (FIG. 5) is applied to the solenoid 50, since the relation of f6>r8 is satisfied, the double-side switching member 22 starts to rotate in the second position Y. Then, as illustrated in FIG. 15C, the second position contacting portion 62*d* of the cam-attached connection plate 62 and the contacting portion 63*b* of the cam are in a contact state. At this time, since the force to push up the cam 63 in an arrow direction illustrated in FIG. 15C disappears, the force to rotate the double-side switching member 22 in the counterclockwise direction is lowered to the force r7 from the force r8. Thereafter, when the double-side switching member 22 abuts on the second position abutting portion 55 (FIG. 3), since the relation of f6*a*>r7*a* is satisfied, the double-side switching member 22 is held at the second position Y.

When the double-side switching member 22 returns from the second position Y to the third position Z and the first position X, the current flowing through the solenoid 50 is stopped. And then, the double-side switching member 22 rotates in the counterclockwise direction in a sequential order from FIG. 15C to FIG. 15B and FIG. 15A due to the force of the double-side switching member return spring 54, and the relation between the cam-attached connection plate 62 and the cam 63 will be also changed at any time. Eventually, the double-side switching member 22 abuts on the first position abutting portion 57 (FIG. 3) to complete the switching operation.

In the third embodiment, when the double-side switching member 22 is operated from the third position Z to the second position Y, it is configured such that the maximum force r8 to rotate the double-side switching member 22 in the counterclockwise direction is generated. Therefore, the third embodiment is configured such that the load is reduced by generating the force r8, which is the peak of the load with respect to the driving force of the solenoid 50.

Thereby, the force to hold the double-side switching member 22 at the second position Y can be reduced. In order to prevent the temperature rise of the solenoid 50, for example, the current flowing through the solenoid 50 is lowered to the current value "c" at the timing (after the elapse of a certain time from the time at which the reversing sheet Sb reaches the tip portion of the double-side switching member 22) of the time T3 illustrated in FIG. 5, but the value of the current value "c" can be set to a lower value.

In a graph of the dashed-dotted line portion illustrated in FIG. 16, furthermore, a slope of force variation from the force r6*a* to the force r8 can be changed by varying the spring constant of the cam pressure spring 64, for example.

In the third embodiment, the force r8 of the maximum load illustrated in FIG. 16 is generated using the cam pressure spring 64, but the invention is not limited thereto and may also obtain the same effect by deforming the cam shape without using the cam pressure spring 64.

<Other Configurations> In the first, second and third embodiments, as described above, when the double-side switching member 22 is switched from the first position X to the second position Y, the double-side switching member 22 is switched to the third position Z in advance. However, the sheet passing through the tip of the double-side switching member 22 is the order of the reversing sheet Sb and the sheet proceeding toward the discharge conveying path 23, and when the interval between the sheets is short, it may be as follows. That is, even when the double-side switching member 22 is switched from the second position Y to the first position X, it may be switched to the first position X after being moved to the third position Z in advance by reducing the current value applied to the solenoid 50, as opposed to suddenly setting the current flowing through the solenoid 50 to zero.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-271400, filed Dec. 12, 2012, which is hereby incorporated by reference herein in its entirety.

What is claimed is:

1. A sheet conveying apparatus which conveys a sheet, comprising:

a sheet conveying path which diverges into a first conveying path and a second conveying path at a diverging point;

a guide member which is movable between a first position where the guide member guides the sheet to the first conveying path and a second position where the guide member guides the sheet to the second conveying path;

a driving portion which is configured to move the guide member to the second position from the first position;

a holding portion which, in a case that the guide member is driven by the driving portion to move to the second position from the first position, provides a load to the driving by the driving portion and holds the guide member at a third position between the first position and the second position; and a force applying portion which applies a force to the guide member in a direction toward the first position, wherein the guide member returns to the first position from the second position by the force applied by the force applying portion.

2. The sheet conveying apparatus according to claim 1, further comprising a sensor configured to detect a sheet position, wherein, when the guide member is driven by the driving portion to be moved to the second position from the first position, the holding portion holds the guide member at the third position when a trailing end of a sheet guided to the first conveying path by the guide member is present at an upstream of the guide member in a conveying direction.

3. The sheet conveying apparatus according to claim 2, wherein, after the guide member is moved to the second position by the driving portion, a driving force of the driving portion is weakened within a range in which a sum of a driving force of the driving portion and a force by its own weight of the guide member is larger than that of a load of the holding portion and a biasing force of the force applying portion.

4. The sheet conveying apparatus according to claim 1, wherein the guide member moves to the second position when a sum of the driving force by the driving portion and a force by its own weight of the guide member is larger than that of a load of the holding portion and the biasing force of the force applying portion, and the guide member is held at the third position when the sum of the driving force by the driving portion and the force by its own weight of the guide member is not larger than that of the load of the holding portion and the biasing force of the force applying portion.

5. The sheet conveying apparatus according to claim 1, further comprising a sensor configured to detect a sheet position, wherein, when the sheet is conveyed in order of a sheet proceeding toward the first conveying path and a succeeding sheet proceeding toward the second conveying path, a timing at which the guide member starts to move to the third position from the first position is before a trailing end of the sheet proceeding toward the first conveying path passes through the guide member, and a timing at which the guide member starts to move to the second position from the third position is after the trailing end of the sheet proceeding toward the first conveying path passes through the guide member, and before a leading end of the sheet proceeding toward the second conveying path passes through the guide member.

6. The sheet conveying apparatus according to claim 1, wherein the third position is a position in which a sheet is not pressed by the guide member.

7. The sheet conveying apparatus according to claim 1, wherein the holding portion is a plate spring to which a certain pressure is provided at the third position.

8. The sheet conveying apparatus according to claim 1, wherein the holding portion is a compression spring in which a spring constant non-linearly changes, and a spring constant of a predetermined region including the third position becomes larger than that of another region.

9. The sheet conveying apparatus according to claim 1, wherein the holding portion has a cam-shaped member, and a peak of a load is generated with respect to the driving portion when the guide member moves to the second position from the third position by the cam-shaped member, and then the load is reduced.

10. The sheet conveying apparatus according to claim 1, wherein the first conveying path is a discharge conveying path which is configured to discharge the sheet out of the sheet conveying apparatus, and the second conveying path is a reverse conveying path which reverses the sheet to convey the reversed sheet.

11. The sheet conveying apparatus according to claim 1, wherein the guide member is moved to the second position from the third position by changing a driving force of the driving portion.

12. A sheet conveying apparatus which conveys a sheet, comprising:

a sheet conveying path which diverges into a first conveying path and a second conveying path at a diverging point;

a guide member which is movable between a first position where the guide member guides the sheet to the first conveying path and a second position where the guide member guides the sheet to the second conveying path;

a sensor configured to detect a sheet position;

a moving portion which, in a case that the guide member is moved to the second position from the first position, temporarily stops the guide member at a third position between the first position and the second position when a trailing end of a sheet guided to the first conveying path by the guide member is present upstream of the guide member in a conveying direction; and a force applying portion which applies a force to the guide member in a direction toward the first position, wherein the guide member returns to the first position from the second position by the force applied by the force applying portion.

13. The sheet conveying apparatus according to claim 12, wherein the moving portion includes:

a driving portion which is configured to move the guide member to the second position from the first position; and a holding portion which provides a load to the driving by the driving portion and holds the guide member at a third position, and the guide member is moved to the second position from the third position and by changing a driving force of the driving portion.

14. The sheet conveying apparatus according to claim 12, further comprising a sensor configured to detect a sheet position, wherein when the sheet is conveyed in order of a sheet proceeding toward the first conveying path and a succeeding sheet proceeding toward the second conveying path, a timing at which the guide member starts to move to the third position from the first position is before a trailing end of the sheet proceeding toward the first conveying path passes through the guide member, and a timing at which the guide member starts to move to the second position from the third position is after the trailing end of the sheet proceeding toward the first conveying path passes through the guide member, and before a leading end of the succeeding sheet proceeding toward the second conveying path passes through the guide member.

15. The sheet conveying apparatus according to claim 12, wherein the third position is a position in which a sheet is not pressed by the guide member.

16. The sheet conveying apparatus according to claim 12, wherein the first conveying path is a discharge conveying path which is configured to discharge the sheet out of the sheet conveying apparatus, and the second conveying path is a reverse conveying path which reverses the sheet to convey the reversed sheet.

17. An image forming apparatus comprising:

a sheet conveying path which diverges into a first conveying path and a second conveying path at a diverging point;

a guide member which is movable between a first position where the guide member guides the sheet to the first conveying path and a second position where the guide member guides the sheet to the second conveying path;

a driving portion which is configured to move the guide member to the second position from the first position;

a holding portion which, in a case that the guide member is driven by the driving portion to move to the second position from the first position, provides a load to the driving by the driving portion and temporarily holds the guide member at a third position between the first position and the second position;

a force applying portion which applies a force to the guide member in a direction toward the first position, wherein the guide member returns to the first position from the second position by the force applied by the force applying portion; and an image forming portion which forms an image on the sheet.

* * * * *